US011201428B2

(12) United States Patent
Martinez Millan et al.

(10) Patent No.: US 11,201,428 B2
(45) Date of Patent: Dec. 14, 2021

(54) CONNECTOR ASSEMBLY WITH CONNECTOR LOCK AND TERMINAL RETAINER

(71) Applicant: Aptiv Technologies Limited, St. Michael (BB)

(72) Inventors: Carlos Alberto Martinez Millan, Torreon (MX); Dennis Garcia Lepez, Saltillo (MX)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/827,335

(22) Filed: Mar. 23, 2020

(65) Prior Publication Data

US 2021/0098924 A1 Apr. 1, 2021

Related U.S. Application Data

(60) Provisional application No. 62/907,009, filed on Sep. 27, 2019.

(51) Int. Cl.
*H01R 13/422* (2006.01)
*H01R 13/436* (2006.01)

(52) U.S. Cl.
CPC ..... *H01R 13/4223* (2013.01); *H01R 13/4361* (2013.01)

(58) Field of Classification Search
CPC ..... H01R 13/4223; H01R 13/4226; H01R 13/4361
USPC ..... 439/595, 354, 358
See application file for complete search history.

(56) References Cited

U.S. PATENT DOCUMENTS 4,679,874 A * 7/1987 Saijo ..... H01R 13/422 439/595
4,984,998 A * 1/1991 Duncan ..... H01R 13/627 439/352
5,496,190 A * 3/1996 Ittah ..... H01R 13/6272 439/354
5,584,719 A * 12/1996 Tsuji ..... H01R 13/6272 439/354
5,622,521 A * 4/1997 Marceau ..... H01R 13/4368 439/595
5,839,923 A 11/1998 Yoshida
6,077,117 A * 6/2000 Iwahori ..... H01R 13/4365 439/595
6,093,063 A * 7/2000 Tsuji ..... H01R 13/4361 439/595

(Continued)

FOREIGN PATENT DOCUMENTS

DE 102008051480 A1 4/2009

OTHER PUBLICATIONS

English Abstract Translation DE102008051480A1, published Apr. 30, 2009.

*Primary Examiner* — Marcus E Harcum
(74) *Attorney, Agent, or Firm* — Billion & Armitage

(57) ABSTRACT

A connector assembly includes a connector body, a terminal retainer configured to retain a terminal within the connector body when the terminal retainer is in a fully staged position, and a connector lock configured to secure the connector body to a corresponding mating connector assembly. The terminal retainer moves from a pre-staged position to the fully staged position as the connector body is mated with the corresponding mating connector assembly.

16 Claims, 9 Drawing Sheets

(56) References Cited

U.S. PATENT DOCUMENTS 6,146,200 A * 11/2000 Ito ..... H01R 13/447
439/596
6,234,826 B1 * 5/2001 Wilber ..... H01R 13/4368
439/352
6,416,700 B1 * 7/2002 Hatagishi ..... B29C 45/0017
264/242
7,104,829 B2 * 9/2006 Volpone ..... H01R 13/6272
439/358
7,137,853 B2 * 11/2006 Okamoto ..... H01R 13/4362
439/752
7,367,835 B2 * 5/2008 Takahashi ..... H01R 13/6272
439/354
7,407,403 B2 * 8/2008 Tanaka ..... H01R 13/6272
439/354
8,210,864 B1 * 7/2012 Hernandez ..... H01R 13/4362
439/352
8,784,141 B2 * 7/2014 Ishikawa ..... H01R 13/501
439/752
9,070,999 B2 * 6/2015 Endo ..... H01R 13/4361
9,608,355 B2 * 3/2017 Nagai ..... H01R 13/4361
9,667,002 B1 * 5/2017 Martin ..... H01R 13/4365
9,843,132 B2 * 12/2017 Ludwig ..... H01R 13/6275
9,917,381 B1 * 3/2018 Campbell ..... H01R 9/16
10,348,019 B1 * 7/2019 Hocevar ..... H01R 13/501
2004/0259417 A1 * 12/2004 Fukamachi ..... H01R 43/18
439/595
2007/0155254 A1 * 7/2007 Daudin ..... H01R 13/4361
439/752
2008/0009171 A1 * 1/2008 Tsuji ..... H01R 13/6272
439/352
2009/0088022 A1 * 4/2009 Krivohlavek ..... H01R 13/501
439/595
2009/0269963 A1 * 10/2009 Brown ..... H01R 13/4362
439/357
2014/0045363 A1 * 2/2014 Mumper ..... H01R 13/501
439/346
2015/0050838 A1 * 2/2015 Copper ..... H01R 13/114
439/626
2015/0200486 A1 * 7/2015 Yagi ..... H01R 13/6272
439/354
2015/0333433 A1 * 11/2015 Yagi ..... H01R 13/4361
439/701
2016/0352035 A1 12/2016 Nagai et al.
2017/0256877 A1 * 9/2017 Matsuura ..... H01R 13/4361
2018/0331452 A1 * 11/2018 Iida ..... H01R 13/4361

* cited by examiner

CONNECTOR ASSEMBLY WITH CONNECTOR LOCK AND TERMINAL RETAINER

CROSS-REFERENCE TO RELATED APPLICATION

This application claims the benefit under 35 U.S.C. § 119(e) of U.S. Provisional Patent Application No. 62/907,009 filed on Sep. 27, 2019, the entire disclosure of which is hereby incorporated by reference.

TECHNICAL FIELD OF THE INVENTION

The invention generally relates to a connector assembly, particularly to a connector body having a connector lock and a terminal retainer.

BACKGROUND OF THE INVENTION

Prior art connector assemblies typically are made of two separate pieces. One piece is a connector body having terminal cavities in which terminals are retained. A second piece provides terminal retainers to retain the terminals within the terminal cavities and connector locks to secure the connector body to a corresponding mating connector body.

These prior art connector assemblies may cause issues for OEMs (Original Equipment Manufacturers) when the second piece having the connector lock and terminal retainer is inserted into the connector body, resulting in an improperly assembled connector assembly and cause further issues in the AP (Assembly Plant) during the connector engagement process with mating connectors. These issues have caused extra inspection steps to be added to the connector engagement process at the AP.

Therefore, a connector assembly that may be assembled without causing issues that require additional inspection during the connector engagement process remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to a first embodiment of the invention, a connector assembly is provided. The connector assembly includes a connector body having a vertical portion and a horizontal portion defining a terminal cavity, a terminal retainer configured to retain a terminal within the terminal cavity, and a connector lock configured to secure the connector body to a corresponding mating connector assembly and further configured to protect the terminal retainer from damage.

In an example embodiment having one or more features of the connector assembly of the previous paragraph, the connector lock comprises an arcuate beam fixed at a first end to the horizontal portion and at a second end to the vertical portion.

In an example embodiment having one or more features of the connector assembly of the previous paragraph, the connector lock comprises a plurality of arcuate beams. Each beam of the plurality of arcuate beams is fixed at a first end to the horizontal portion and at a second end to the vertical portion.

In an example embodiment having one or more features of the connector assembly of the previous paragraph, the terminal retainer is arranged intermediate the connector lock and the connector body.

In an example embodiment having one or more features of the connector assembly of the previous paragraph, the connector body, the connector lock, and the terminal retainer are integrally formed.

In an example embodiment having one or more features of the connector assembly of the previous paragraph, the terminal retainer is attached to the horizontal portion of the connector body by a flexible hinge.

In an example embodiment having one or more features of the connector assembly of the previous paragraph, a free end of the terminal retainer is arranged opposite the hinge.

In an example embodiment having one or more features of the connector assembly of the previous paragraph, the free end of the terminal retainer has an angled latching feature that is configured to engage a corresponding angled latching feature defined by the horizontal portion of the connector body.

In an example embodiment having one or more features of the connector assembly of the previous paragraph, the hinge is arranged closer to an end of the horizontal portion and the free end is arranged closer to the vertical portion.

In an example embodiment having one or more features of the connector assembly of the previous paragraph, the free end the hinge is arranged closer to the vertical portion and the flexible hinge is arranged closer to an end of the horizontal portion.

In an example embodiment having one or more features of the connector assembly of the previous paragraph, the terminal retainer is maintained in a pre-staged position by a frangible member.

In an example embodiment having one or more features of the connector assembly of the previous paragraph, the terminal retainer is configured to allow the terminal to be inserted within the connector body when in the pre-staged position.

In an example embodiment having one or more features of the connector assembly of the previous paragraph, the frangible member is configured to be broken as the terminal retainer is moved from the pre-staged position to a staged position.

According to a second embodiment of the invention, a connector assembly is provided. The connector assembly includes a connector body having a vertical portion and a horizontal portion defining a terminal cavity, means for retaining a terminal within the terminal cavity, and means for protecting the means for retaining the terminal from damage.

In an example embodiment having one or more features of the connector assembly of the previous paragraph, the connector assembly further comprises means for securing the connector body to a corresponding mating connector assembly.

BRIEF DESCRIPTION OF THE SEVERAL VIEWS OF THE DRAWING

The present invention will now be described, by way of example with reference to the accompanying drawings, in which.

Figure 1:
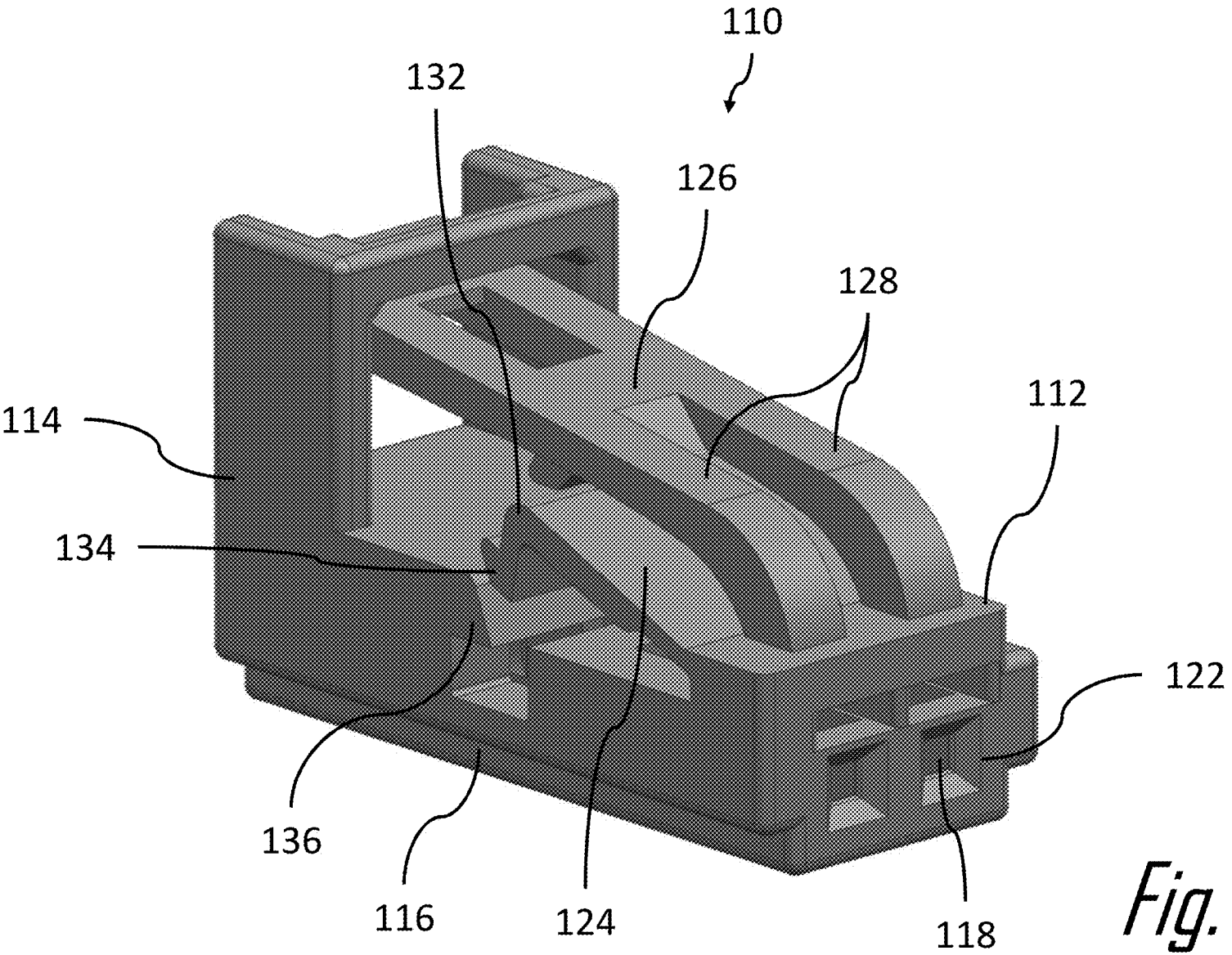
FIG. 1 is a perspective view of a connector assembly in accordance with a first embodiment of the invention.
Figure 2:
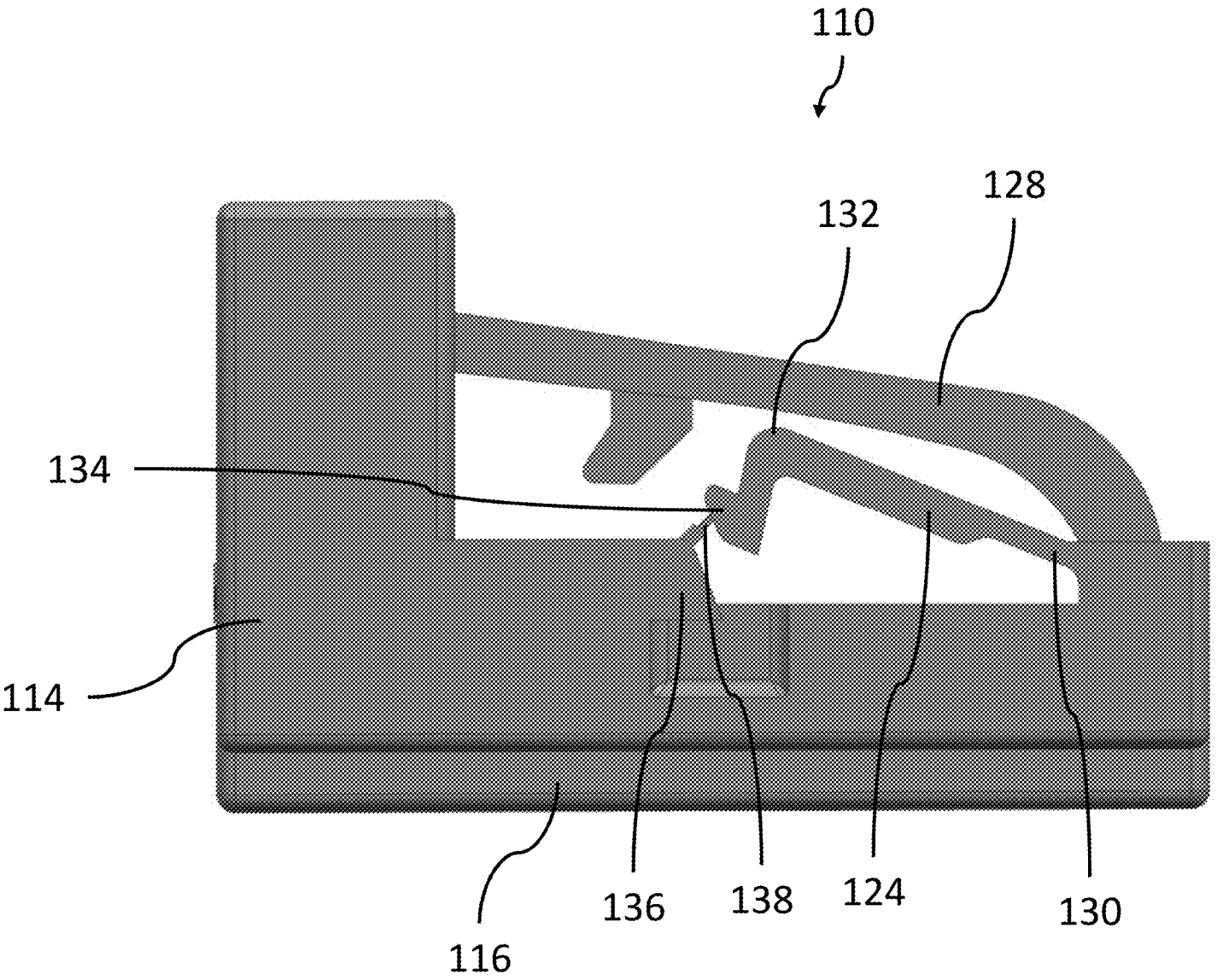
FIG. 2 is a side view of the connector assembly of FIG. 1 in accordance with the first embodiment of the invention.
Figure 3:
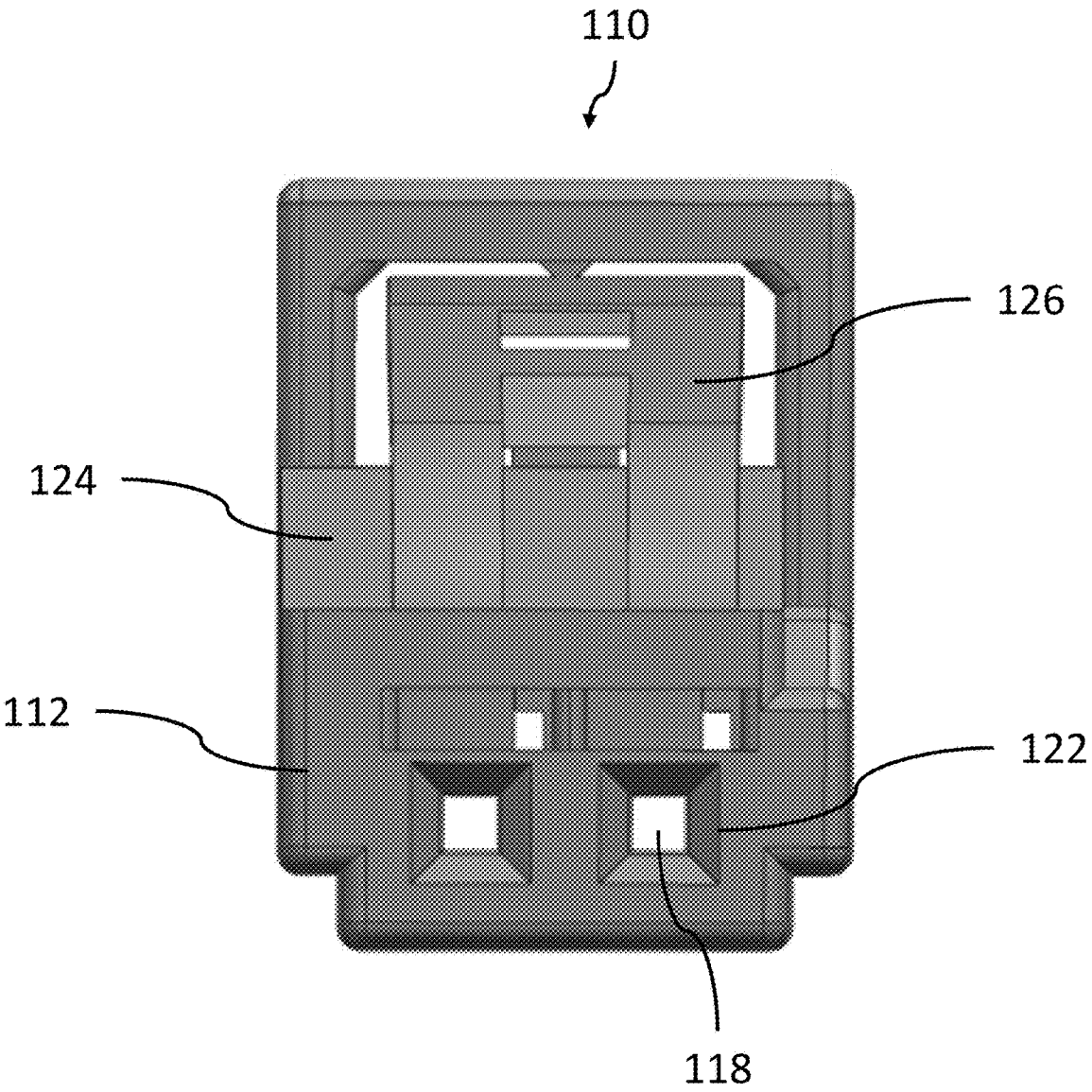
FIG. 3 is a front view of the connector assembly of FIG. 1 in accordance with the first embodiment of the invention.
Figure 4:
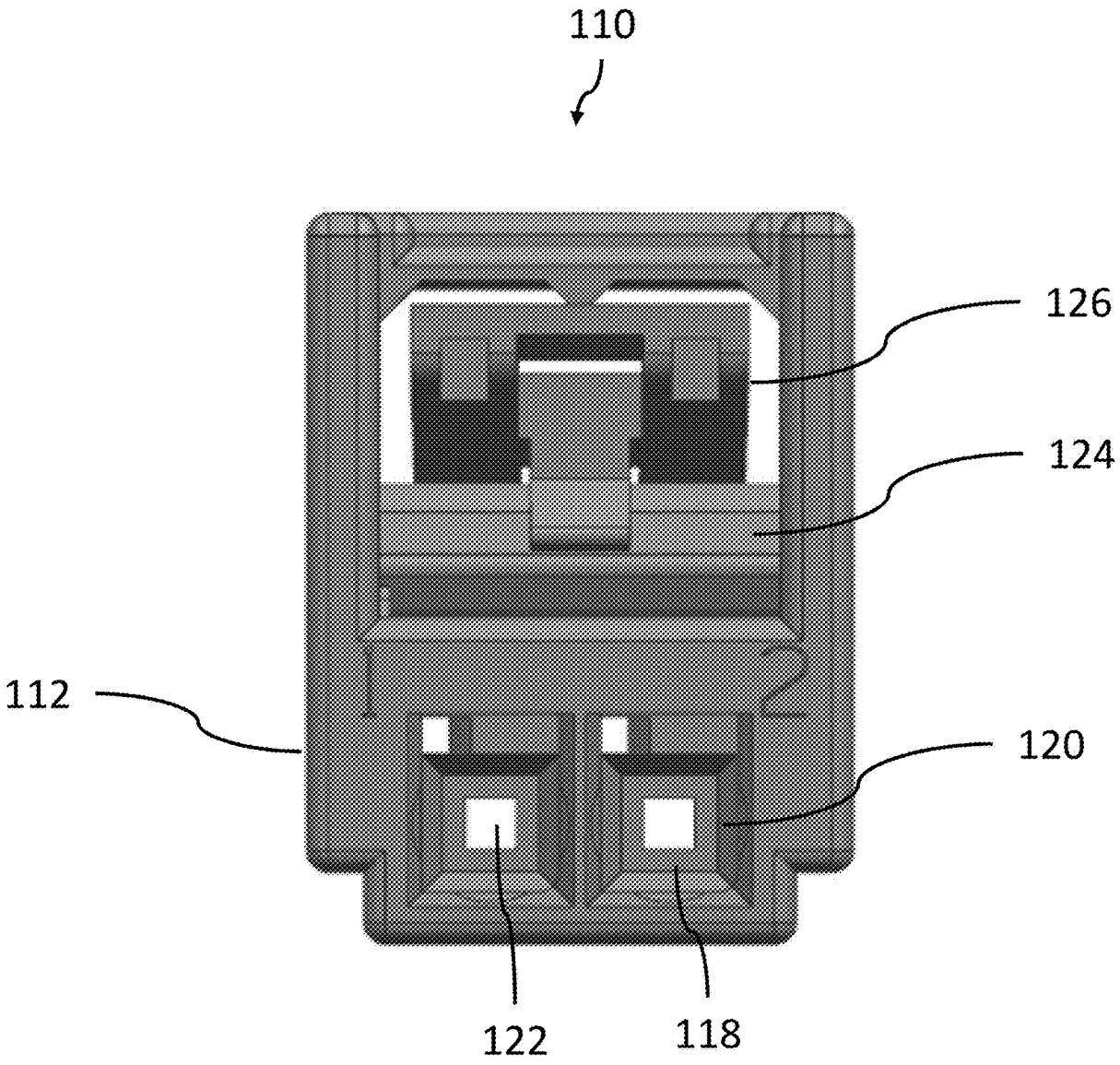
FIG. 4 is a rear view of the connector assembly of FIG. 1 in accordance with the first embodiment of the invention.
Figure 5:
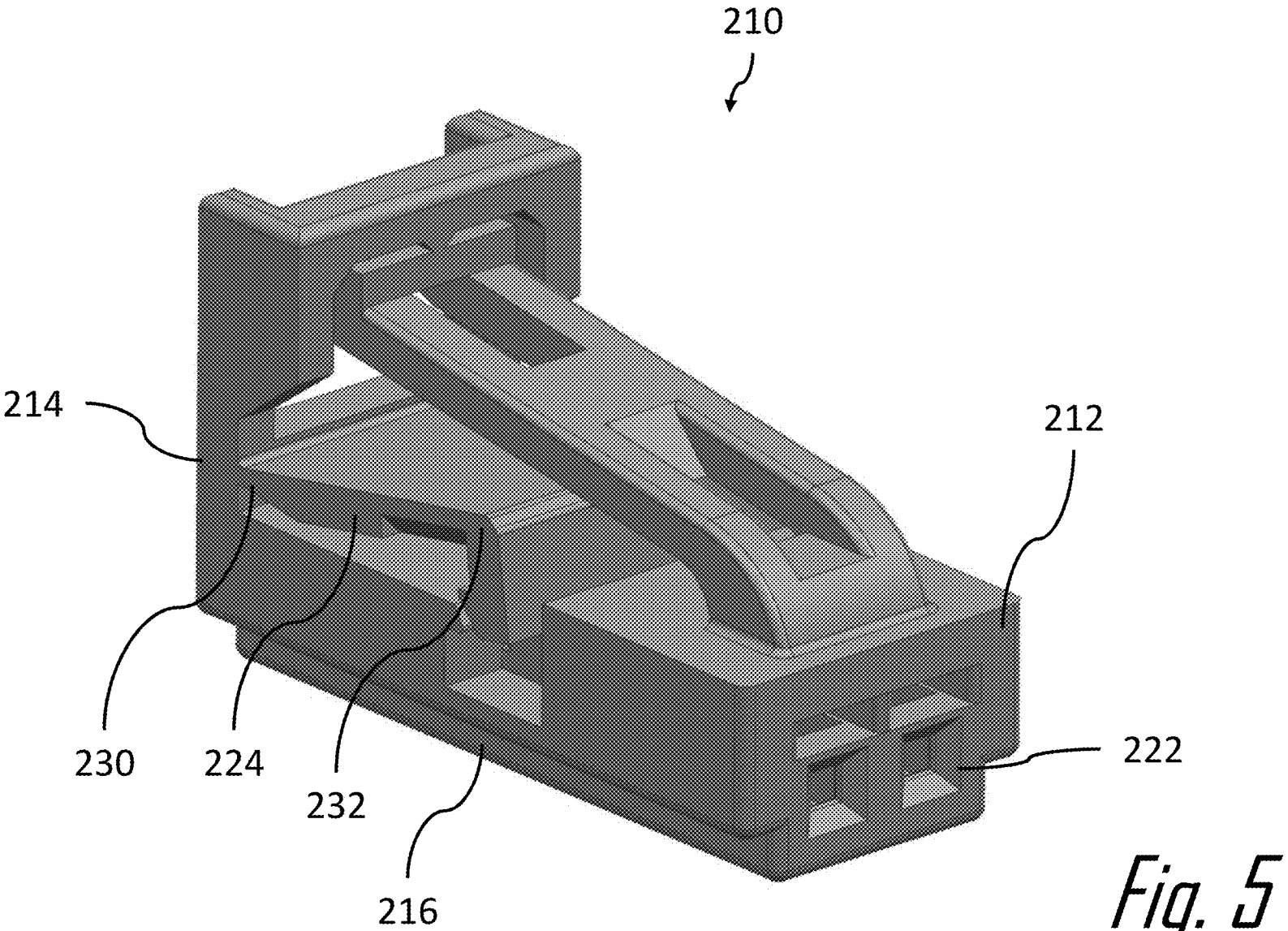
FIG. 5 is a perspective view of a connector assembly in accordance with a second embodiment of the invention.
Figure 6:
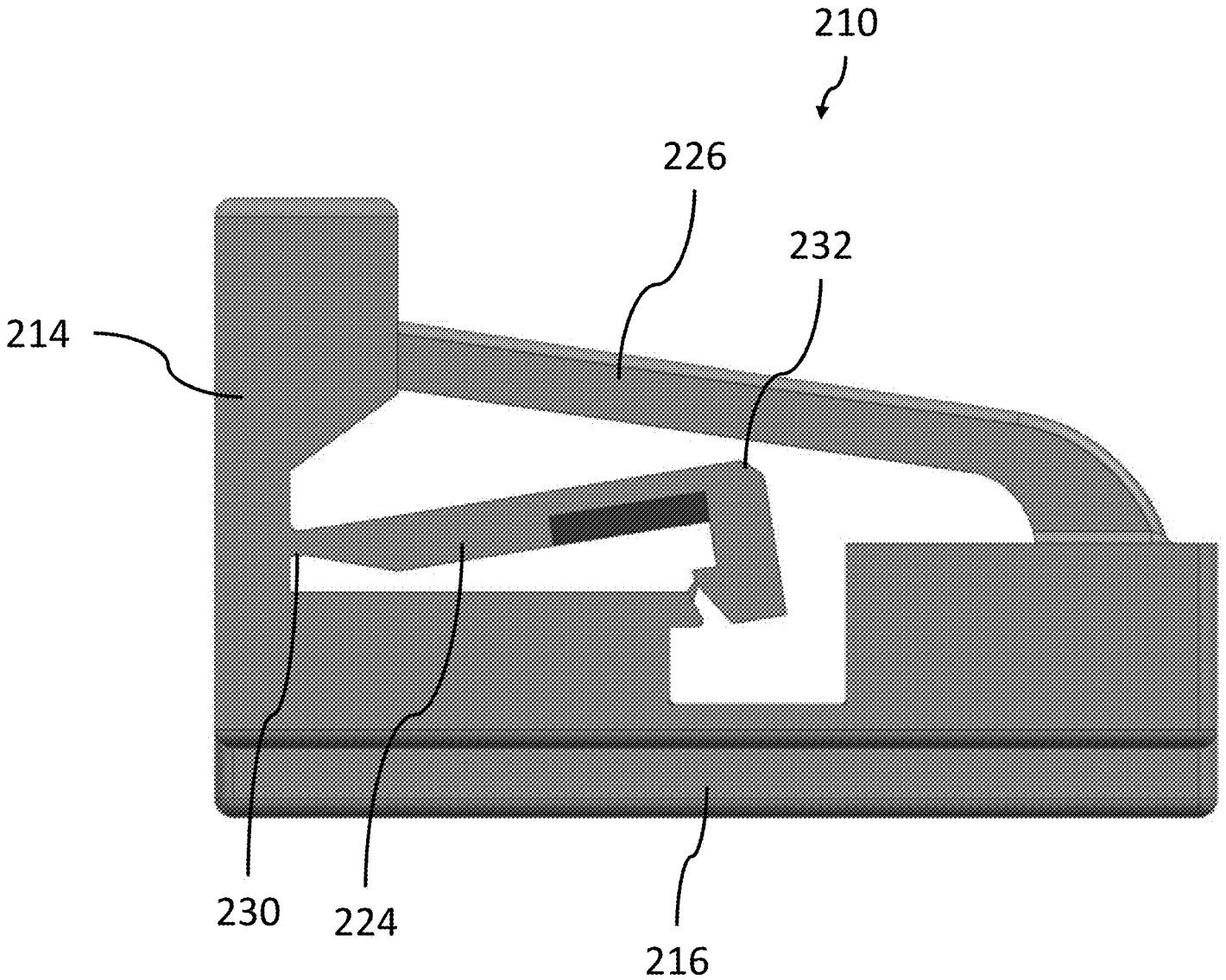
FIG. 6 is a side view of the connector assembly of FIG. 5 in accordance with the second embodiment of the invention.
Figure 7:
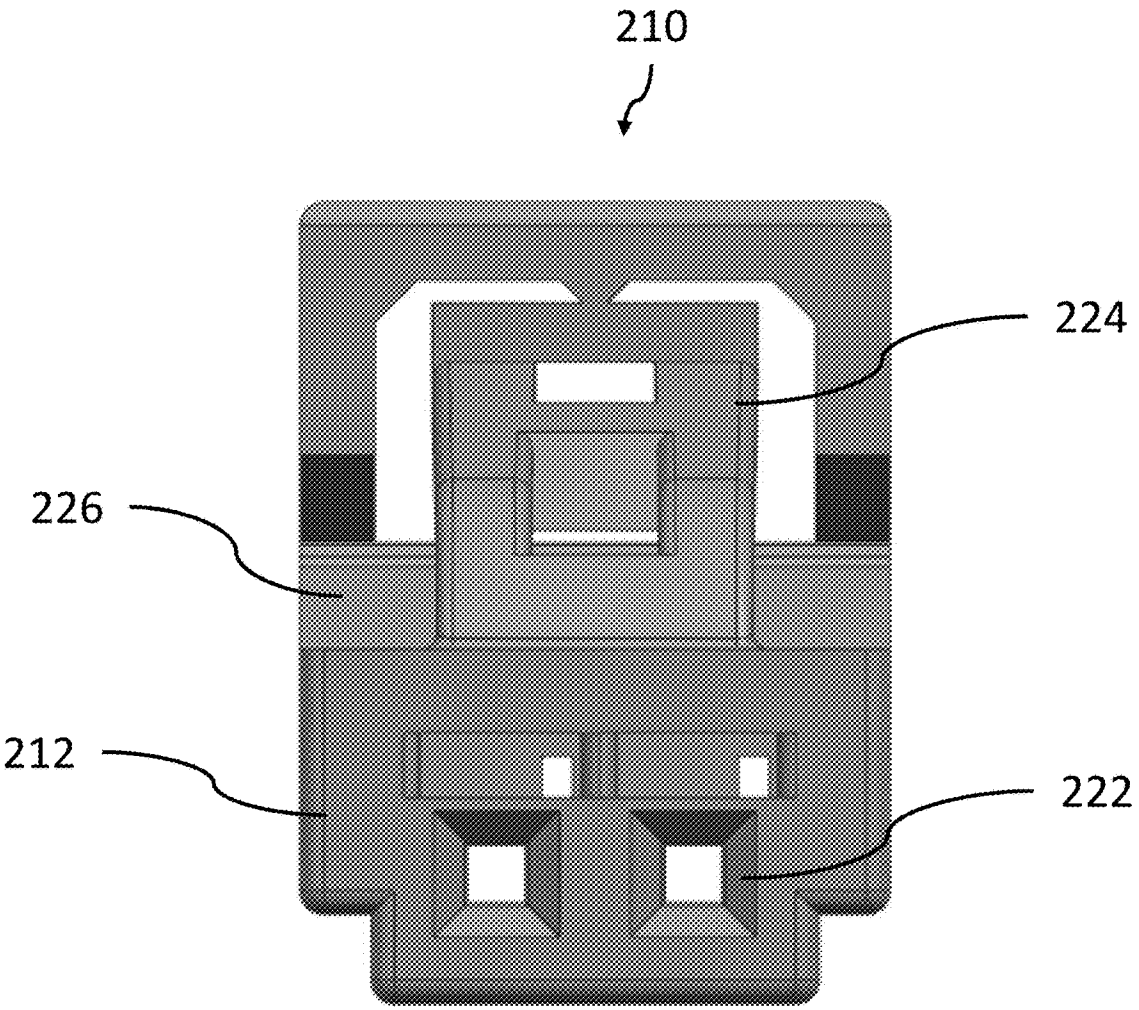
FIG. 7 is a front view of the connector assembly of FIG. 5 in accordance with the second embodiment of the invention.
Figure 8:
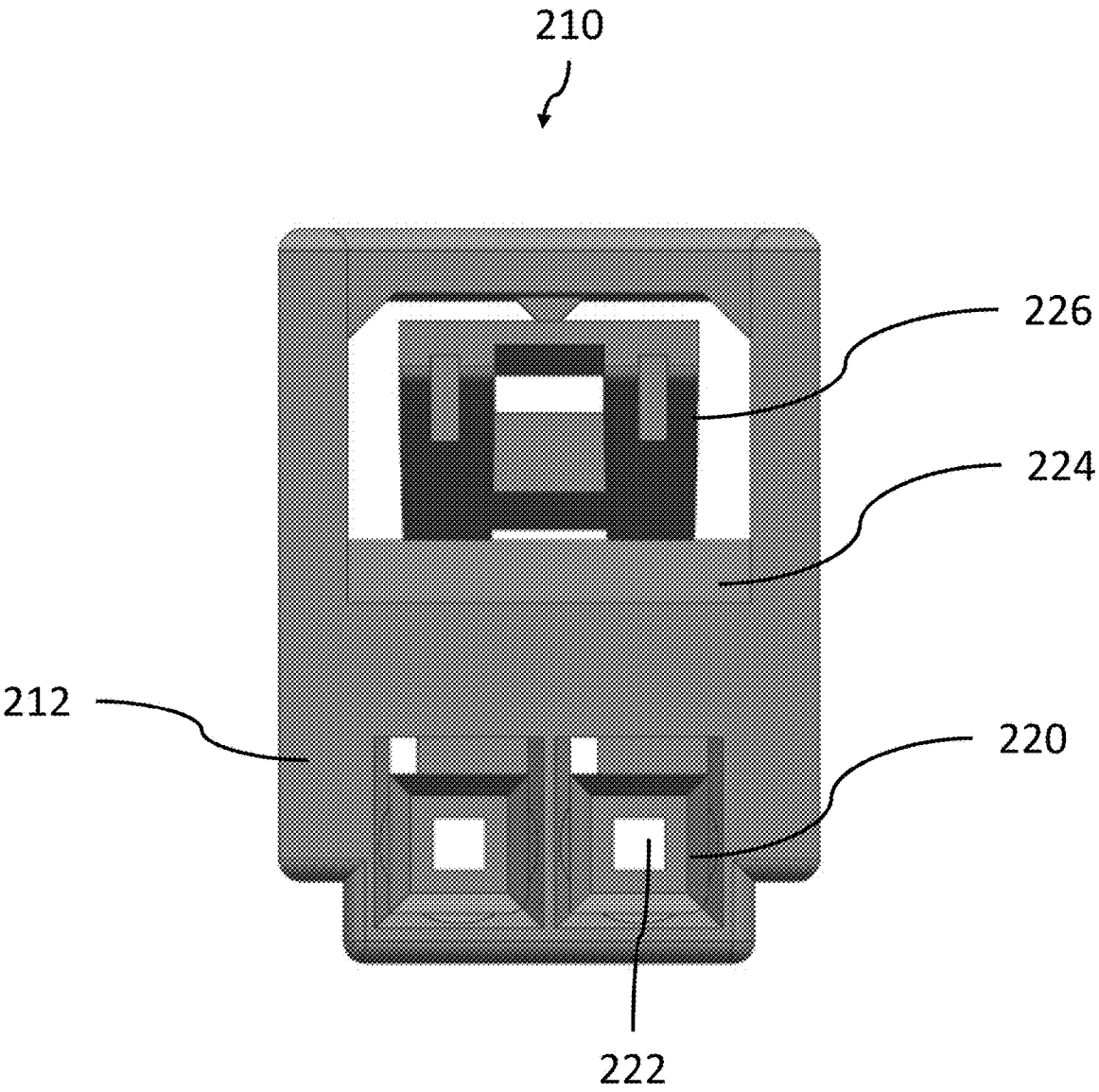
FIG. 8 is a rear view of the connector assembly of FIG. 2 in accordance with the second embodiment of the invention.

Similar features in the different embodiments described below share the last two digits of the reference numbers in the figures.

DETAILED DESCRIPTION OF THE INVENTION

An example of an electrical connector assembly 110 embodying at least some of the inventive features is presented in FIGS. 1-4. The connector assembly 110 includes an L-shaped connector body 112 having a vertical backstop portion 114 and a horizontal portion 116. The connector body 112 defines at least one terminal cavity 118 and typically a plurality of terminal cavities 118 that extend through the connector body 112. The terminal cavities 118 are arranged to have an insertion opening 120 in the vertical portion 114 through which the terminals attached to a wire cable (not shown) are inserted within the connector body 112 and a connection opening 122 in the horizontal portion 116 through which the electrical terminals mate with corresponding electrical terminals in a corresponding mating connector assembly (not shown).

The connector assembly 110 also includes a terminal retainer 124 that is configured to retain the electrical terminal within the terminal cavity. The connector assembly 110 further includes a connector lock 126 that is configured to secure the connector body 112 to the corresponding mating electrical connector assembly. The connector assembly 110 is formed of a dielectric material, e.g. a polyamide material. The connector body 112, the connector lock 126, and the terminal retainer 124 are integrally formed. The connector lock 126 includes a pair of arcuate cantilevered beams 128. Each of the beams 128 is fixed to the horizontal portion 116. In alternative embodiments of the connector assembly the connector lock may have a single arcuate beam or three or more arcuate beams.

The terminal retainer 124 is attached to the horizontal portion 116 of the connector body 112 by a flexible hinge 130. A free end 132 of the terminal retainer 124 is arranged opposite the hinge 130. The free end 132 of the terminal retainer 124 has an angled latching feature 134 that is configured to engage a corresponding angled latching feature 136 defined by the horizontal portion 116 of the connector body 112. In the embodiment illustrated in FIGS. 1-4 the hinge 130 is arranged closer to an end of the horizontal portion 116 having the connection openings 122 and the free end 132 is arranged closer to the vertical portion 114 having the insertion openings 120.

When the terminal retainer 124 is in a pre-staged position, the latching feature 134 is not engaged with the latching feature 136, and the terminal retainer 124 allows a terminal to be inserting into the terminal cavity through the insertion opening 120. When the terminal retainer 124 is in a staged position, the latching feature 134 is engaged with the latching feature 136 and the terminal retainer 124 inhibits removal of the terminal from the terminal cavity. Because the terminal retainer 124 is arranged between the connector lock 126 and the horizontal portion 116 of the connector body 112, the connector lock 126 protects the terminal retainer 124 the terminal retainer 124 to avoid overstressing the hinge 130 caused by overrotation of the terminal retainer 124, which could damage the terminal retainer 124. The arcuate beams 128 of the connector lock 126 limit the rotation of the terminal retainer 124 around the hinge 130 to less than 90 degrees, preferably less than 45 degrees, and more preferably to less than 30 degrees. The terminal retainer is maintained in the pre-staged position by a frangible member 138 that is broken when the terminal retainer is moved from the pre-staged position to the staged position.

In another embodiment of the connector assembly 210 illustrated in in FIGS. 5-8, the connector assembly 210 having a connector body 212, terminal retainer 224, and connector lock 226 that is similarly constructed to the connector assembly 110 with the exception of the free end 232 the flexible hinge 230 of the terminal retainer 224 being arranged closer to a vertical portion 214 of the connector body 212 having insertion openings 220 and the hinge 230 being arranged closer to an end of a horizontal portion 216 having connection openings 222.

While the examples presented herein are directed to electrical connector assemblies 110, 210, other embodiments may be envisioned that are adapted for use with other types of connector assemblies for fiber optic cables, pneumatic tubes, hydraulic tubes, or a hybrid connector assembly including two or more of the items listed above.

Figure 9:
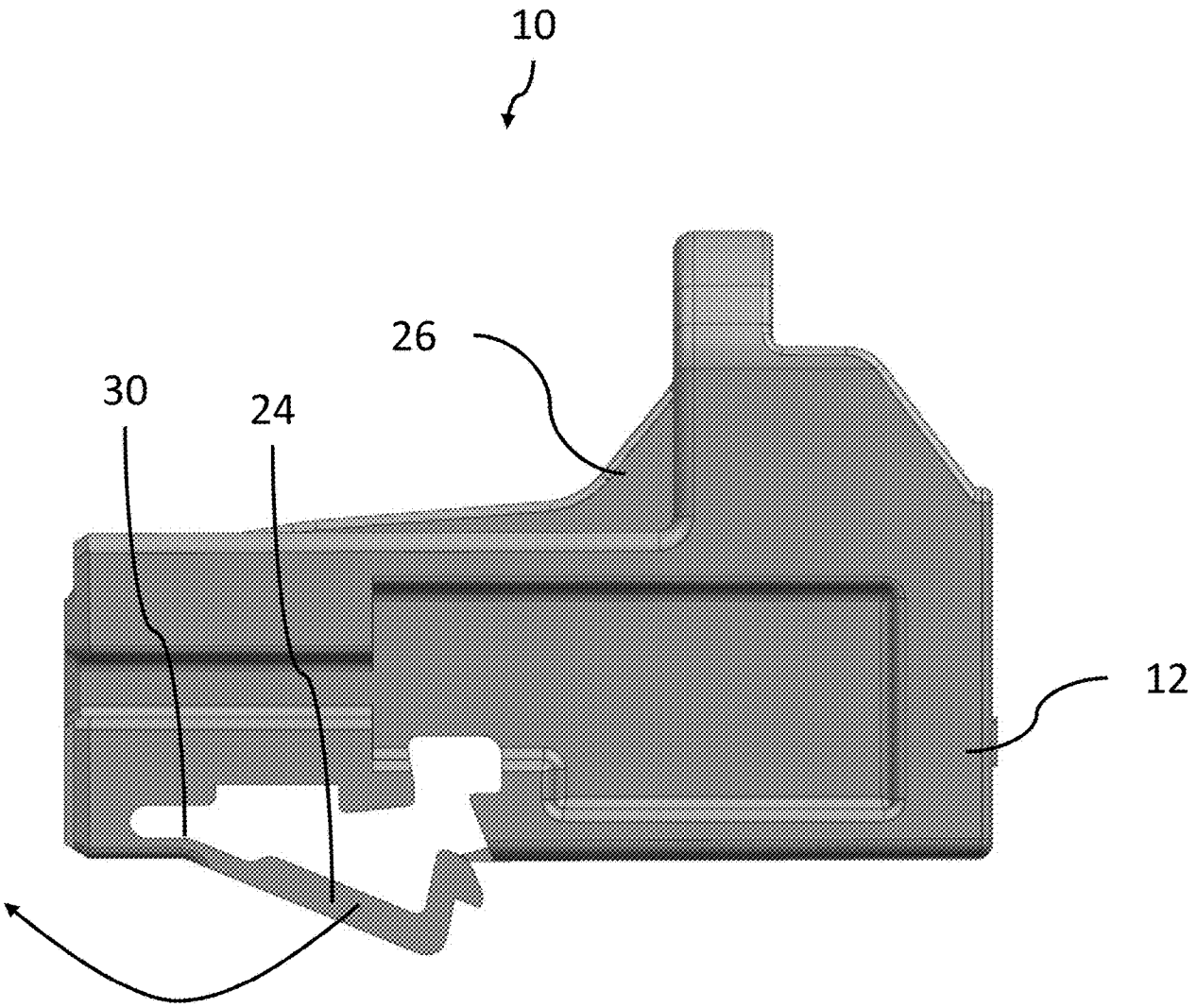
Fig. 9 Prior Art
FIG. 9 is a side view of a connector assembly in accordance the prior art.

The connector assembly 110, 210 solves a problem related to restrictions on size and mating configuration by incorporating the terminal retainer 124, 224 on the same side of the connector body 112, 212 as the connector lock 126, 226. They also reduce the likelihood of damage that is possible with the prior art connector assembly 10 shown in FIG. 9 that could be caused by overstressing of the hinge 30 of the terminal retainer 24. The hinge 30 of connector assembly 10 can rotate up to 180 degrees since the rotation is not limited by the connector lock 26, which is on the opposite side of the connector body 12, or any other feature.

The connector assembly 110, 210 presented herein provides the advantages of providing a single piece connector body 112, 212 with a connector lock 126, 226 and terminal retainer 124, 224 which will reduce assembly time and handling issues caused by connector and terminal retainers having two separate pieces in the processes of assembling the connector assembly 110, 210. Additionally, connector assembly 110, 210 provides the advantage of the connector lock 126, 226 protecting the terminal retainer 124, 224 to avoid undesirable upward movement of the terminal retainer 124, 224 from the pre-staged position, which could damage the terminal retainer 124, 224 during handling, the assembly process, or any subsequent maintenance operations.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A connector assembly, comprising: a connector body having a vertical portion and a horizontal portion defining a terminal cavity; a terminal retainer attached to the connector body by a flexible hinge and configured to retain a terminal within the terminal cavity; and a connector lock configured to secure the connector body to a corresponding mating connector assembly and further configured to limit rotation of the terminal retainer around the flexible hinge, wherein the connector body, the connector lock, and the terminal retainer are integrally formed; wherein the connector body has a vertical portion and a horizontal portion defining the terminal cavity and wherein the connector lock comprises an arcuate beam fixed at a first end to the horizontal portion and fixed at a second end to the vertical portion.

2. The connector assembly in accordance with claim 1, wherein the connector lock comprises a plurality of arcuate beams, wherein each beam of the plurality of arcuate beams is fixed at a first end to the horizontal portion and fixed at a second end to the vertical portion.

3. The connector assembly in accordance with claim 1, wherein the terminal retainer is arranged between the connector lock and the connector body.

4. The connector assembly in accordance with claim 1, wherein a free end of the terminal retainer is arranged opposite the flexible hinge.

5. The connector assembly in accordance with claim 4, wherein the free end of the terminal retainer has an angled latching feature that is configured to engage a corresponding angled latching feature defined by the horizontal portion of the connector body.

6. The connector assembly in accordance with claim 4, wherein the flexible hinge is arranged closer to an end of the horizontal portion and the free end is arranged closer to the vertical portion.

7. The connector assembly in accordance with claim 4, wherein the free end is arranged closer to the vertical portion and the flexible hinge is arranged closer to an end of the horizontal portion.

8. The connector assembly in accordance with claim 4, wherein the terminal retainer is maintained in a pre-staged position by a frangible member.

9. The connector assembly in accordance with claim 8, wherein the terminal retainer is configured to allow the terminal to be inserted within the connector body when in the pre-staged position.

10. The connector assembly in accordance with claim 8, wherein the terminal retainer is configured to retain the terminal within the connector body when in a staged position.

11. A connector assembly, comprising: a connector body having a vertical portion and a horizontal portion defining a terminal cavity; a terminal retainer attached to the connector body by a flexible hinge and configured to retain a terminal within the terminal cavity; and means for limiting rotation of the terminal retainer around the flexible hinge to less than 45 degrees, wherein the connector body and the means for limiting rotation of the terminal retainer are integrally formed.

12. The connector assembly in accordance with claim 11, wherein the connector assembly further comprises means for securing the connector body to a corresponding mating connector assembly.

13. The connector assembly in accordance with claim 1, wherein the connector lock is configured to limit rotation of the terminal retainer around the flexible hinge to less than 90 degrees.

14. The connector assembly in accordance with claim 13, wherein the connector lock is configured to limit rotation of the terminal retainer around the flexible hinge to less than 45 degrees.

15. The connector assembly in accordance with claim 14, wherein the connector lock is configured to limit rotation of the terminal retainer around the flexible hinge to less than 30 degrees.

16. The connector assembly in accordance with claim 11, comprising means for limiting rotation of the terminal retainer around the flexible hinge to less than 30 degrees.

* * * * *